US006099328A

United States Patent [19]

Nelson et al.

[11] Patent Number: 6,099,328

[45] Date of Patent: Aug. 8, 2000

[54] HIGH-SPEED EDGE CONNECTOR

[75] Inventors: Richard A. Nelson, Geneva; David L. Brunker, Naperville, both of Ill.

[73] Assignee: Molex Incorporated, Lisle, Ill.

[21] Appl. No.: 09/082,834

[22] Filed: May 21, 1998

[51] Int. Cl.[7] ..... H01R 4/66

[52] U.S. Cl. ..... 439/101; 439/637

[58] Field of Search ..... 439/101, 108, 439/637, 60, 608

[56] References Cited

U.S. PATENT DOCUMENTS

| | | | |
|---|---|---|---|
| 3,871,728 | 3/1975 | Goodman | 339/14 R |
| 4,806,103 | 2/1989 | Kniese et al. | 439/637 |
| 4,993,972 | 2/1991 | Lin | 439/637 |
| 5,112,231 | 5/1992 | Harwath et al. | 439/60 |
| 5,192,220 | 3/1993 | Billman et al. | 439/327 |
| 5,249,988 | 10/1993 | Lu | 439/751 |
| 5,259,768 | 11/1993 | Brunker et al. | 439/60 |
| 5,309,630 | 5/1994 | Brunker et al. | 29/842 |
| 5,393,234 | 2/1995 | Yamada et al. | 439/62 |
| 5,522,737 | 6/1996 | Brunker et al. | 439/60 |
| 5,580,257 | 12/1996 | Harwath | 439/637 |
| 5,730,609 | 3/1998 | Harwath | 439/637 |

*Primary Examiner*—Gary F. Paumen
*Attorney, Agent, or Firm*—Charles S. Cohen

[57] ABSTRACT

An electrical edge connector and a terminal therefore for connecting a first electrical circuit board to a second electrical circuit board, the first electrical circuit board having an insertion edge and two sides, the connector comprising an elongated dielectric housing having therein a longitudinal slot for receiving the insertion edge of the first electrical circuit board and a plurality of transverse terminal receiving cavities adjoining the slot on each side of the slot, and a plurality of signal terminals disposed within some of the terminal retention cavities on each side of the slot and a plurality of ground terminals disposed within others of the terminal retention cavities on each side of the slot, the signal and ground terminals each having a base portion, a retention portion extending from the base portion and retaining the terminal in one of the retention cavities, a tail portion extending from the base portion for electrically connecting the terminal to the second electrical circuit, and a spring arm connected to the base portion for electrically connecting the terminal to the first electrical circuit board, the ground terminals including a generally tapered, enlarged surface area portion for enhancing electrical coupling between the ground terminal and an adjacent signal terminal.

16 Claims, 4 Drawing Sheets

HIGH-SPEED EDGE CONNECTOR

BACKGROUND OF THE INVENTION

The invention pertains generally to electrical connectors for computers, and more specifically to high-speed edge connectors for mechanically and electrically connecting electrical circuits, such as two printed circuit boards.

As computers continue to process data at ever-increasing rates, "bus" type electrical connectors, such as those electrically connecting a processor to random access memory, are being asked to provide increasingly higher data transfer rates through increasingly smaller spaces. In particular, there is pressure to reduce the size of the connectors while increasing the data throughput.

However, countervailing mechanical and electrical performance considerations have continued to inhibit very high data transfer rates. In general, short, thick terminals are capable of providing lower inductance and thereby enhancing electrical performance. This can be achieved through ample surface area and minimal series path impedance, so as to minimize signal degradation. Mechanically, however, longer, thinner terminals are generally preferable to retain contact flexibility, facilitate mating criteria, and meet pitch/density specifications.

Thus, there is a demand for denser edge connectors having faster data transfer rates while not sacrificing mechanical integrity or signal quality. A dense array of parallel paths, however, can result in significant signal-degrading cross-talk and/or undesirable levels of electromagnetic interference.

SUMMARY OF THE INVENTION

The inventive electrical connector and terminals, disclosed and claimed herein, significantly improve data transfer rates between electrical circuits without substantial signal degradation, electromagnetic interference, or mechanical weakening. The terminals have been designed particularly to minimize impedance and signal degradation while not significantly diminishing mechanical strength, and the particular terminals have been strategically arranged within the connector to further minimize cross-talk and electromagnetic interference.

In one aspect of this invention, there is provided an electrical edge connector for electrically and mechanically connecting a first electrical circuit board to a second electrical circuit board, the first electrical circuit board having an insertion edge and two sides. The connector includes an elongated dielectric housing having therein a longitudinal slot for engaging the insertion edge of the first electrical circuit board and a plurality of transverse terminal receiving cavities adjoining the slot on each of its sides, a plurality of signal terminals disposed within some of the terminal receiving cavities on each side of the slot and a plurality of ground terminals disposed within others of the terminal receiving cavities on each side of the slot. The signal and ground terminals each have a base portion, a retention portion extending from the base portion for retaining the terminal in one of the receiving cavities, a tail portion extending from the base portion for electrically connecting the terminal to the second electrical circuit board, and a spring arm connected to the base portion for electrically connecting the terminal to the first electrical circuit board, wherein each ground terminal includes a generally tapered, enlarged surface area portion extending from its base portion adjacent the spring arm for enhancing electrical coupling between the ground terminal and an adjacent signal terminal.

In another aspect of this invention, there is provided an electrical edge connector for electrically and mechanically connecting a first electrical circuit board to a second electrical circuit board, the first electrical circuit board having an insertion edge in two sides. In this aspect, the connector includes an elongated dielectric housing having therein a longitudinal slot for engaging the insertion edge of the first electrical circuit, a plurality of transverse terminal receiving cavities adjoining the slot on each side of the slot, and a plurality of first, second, and third terminals each disposed within some of the terminal receiving cavities on each side of the slot. Each of the three distinct terminals has a base portion, a retention portion extending from the base portion for retaining the terminal in one of the receiving cavities, a tail portion extending from the base portion for electrically connecting the terminal to the second electrical circuit, and a spring arm connected to the base portion for electrically connecting the terminal to the first electrical circuit.

Yet another aspect of the invention is a terminal for use in an electrical edge connector for connecting a first electrical circuit board to a second electrical circuit board, wherein the first electrical circuit board has an insertion edge and two sides and said connector has an elongated dielectric housing having therein a longitudinal slot for engaging the insertion edge of the first electrical circuit and a plurality of transverse terminal receiving cavities adjoining the slot on each side of the slot. The terminal includes a base portion, a retention portion extending from the base portion for retaining the terminal in one of the receiving cavities, a tail portion extending from the base portion for electrically connecting the terminal to the second electrical circuit board, a spring arm connected to the base portion for electrically connecting the terminal to the first electrical circuit board, and a tapered, enlarged surface area portion extending upwardly from the base portion adjacent the spring arm for enhancing electrical coupling between the terminal and an adjacent terminal.

DETAILED DESCRIPTION OF THE PREFERRED EMBODIMENT

Figure 1:
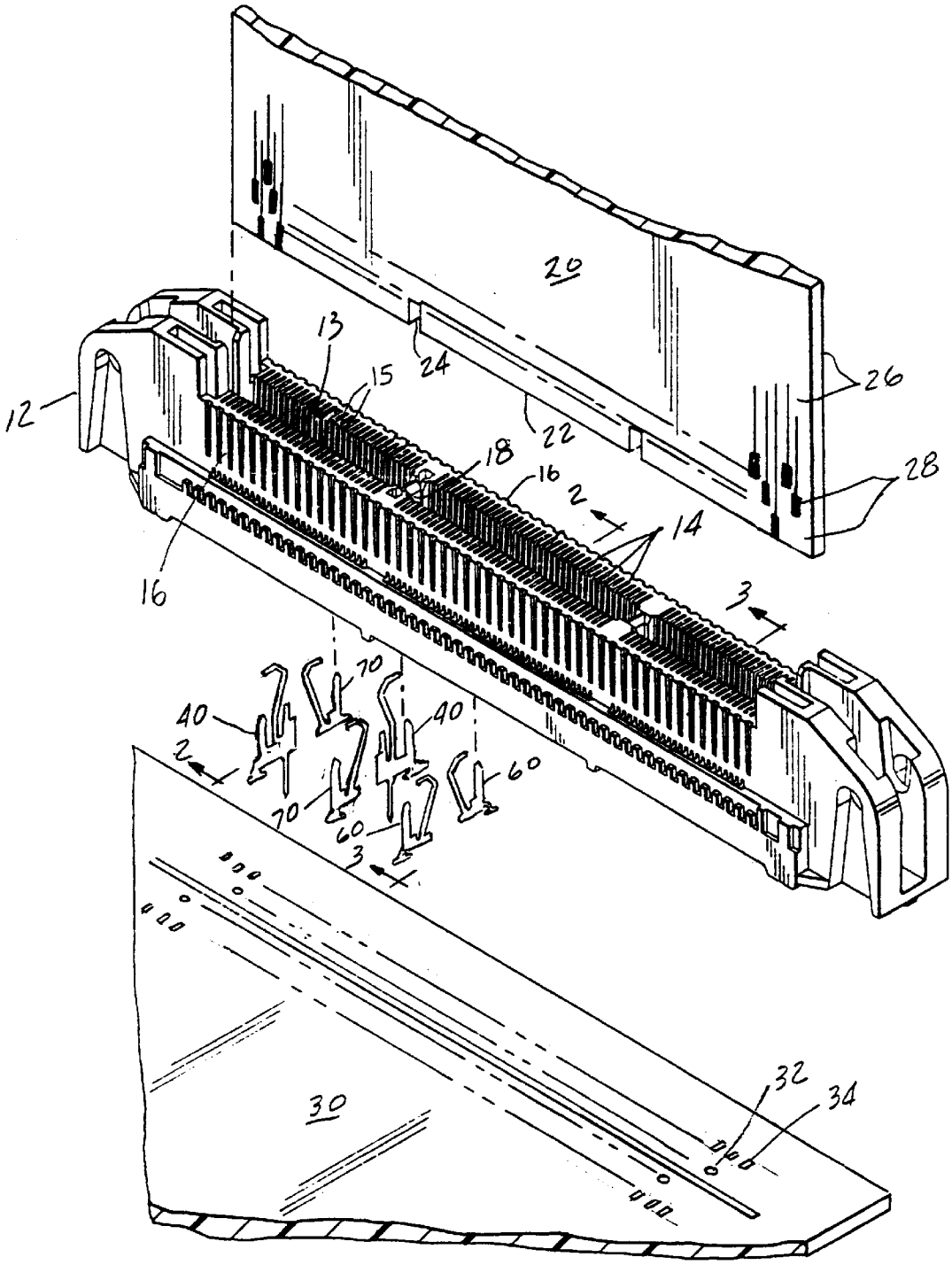
FIG. 1 is an exploded perspective view of the inventive edge connector and terminals as seen in their general environment for application.

The preferred embodiment of the invention is a connector 10 for electrically and mechanically connecting a first electrical circuit on edge card 20 to a second electrical circuit on motherboard 30. As seen in exploded view in FIG. 1, the connector includes a dielectric housing 12 defining a longitudinal slot 13 and a plurality of transversely oriented terminal retention cavities 14 on both sides of the slot 13. The terminal receiving cavities 14 are defined at least in part by transverse walls 15 that extend from sidewalls 16 towards slot 13. While not necessary to the invention or shown in the drawings, the preferred embodiment additionally has mounting pegs (not shown) on the bottom of the housing 12 for facilitating mounting of the connector onto the motherboard 30. Keys 18 preferably provide additional structural stability to the connector and facilitate alignment of the edge card 20 within the longitudinal slot 13 of the connector.

FIG. 1 also shows the edge card 20 having an insertion edge 22 for inserting into the longitudinal slot 13 of the connector. The insertion edge 22 preferably has notches or keyways 24 for engaging the keys 18 upon insertion of the edge card 20 into the longitudinal slot 13. The alignment of the keyways 24 and the keys 18 facilitates alignment between the edge card 20 and housing 12, and may also provide for polarization to prevent insertion of the edge card 20 in an improper orientation. The edge card 20 has oppositely facing generally planar surfaces 26 with pads 28 or other forms of electrical contacts proximate the insertion edge 22. The pads 28 are sufficiently near the insertion edge 22 such that they are at least partially inside the longitudinal slot 13 of the housing 12 when the edge card 20 has been fully inserted therein.

The connector is preferably mounted onto and aligned with the motherboard 30 by inserting the mounting pegs (not shown) attached to the bottom of the housing 12 into appropriately sized apertures (not shown) in the motherboard 30. The motherboard 30 may electrically interface with the connector by a plurality of through-holes 32 extending through the board and/or by a plurality of traces 34 or other surface-type electrical pads thereon.

Figure 4:
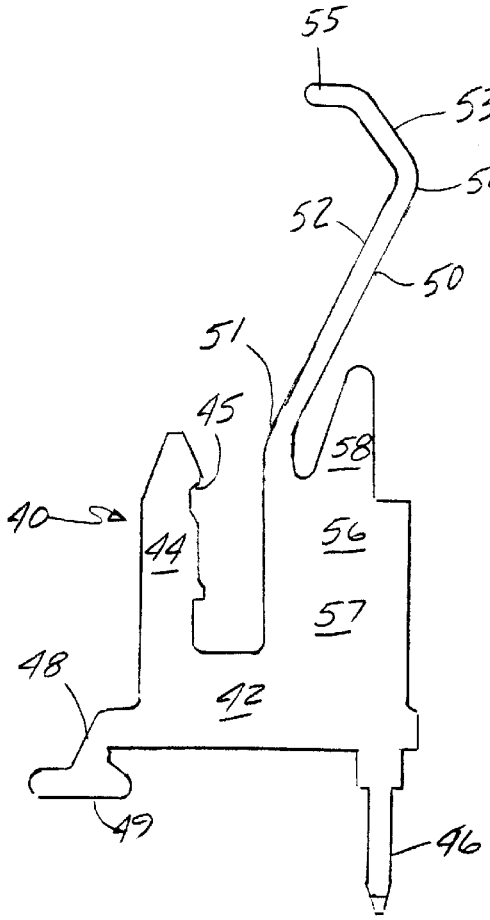
FIG. 4 is a front elevational view of a ground terminal in accordance with the invention.
Figure 6:
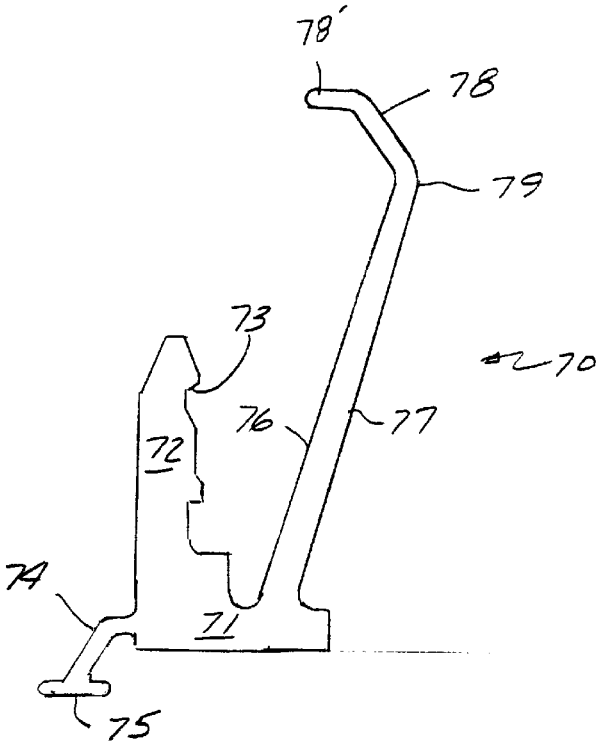
FIG. 6 is a front elevational view of a middle terminal in accordance with the invention.
Figure 7:
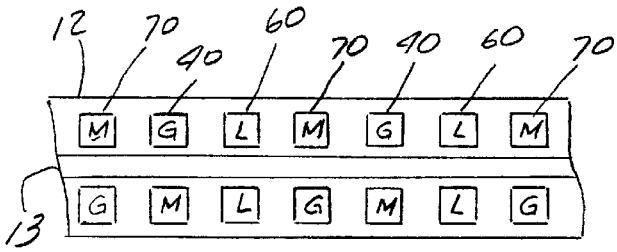
FIG. 7 is a broken, schematic plan view of the arrangement of distinct terminals within the terminal retention cavities of the inventive connector.
Figure 5:
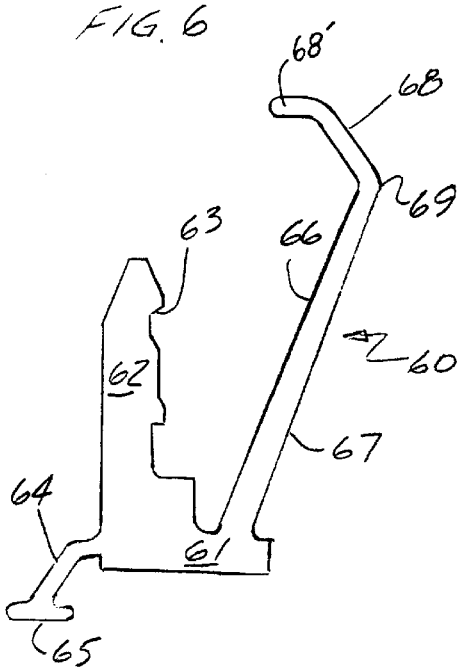
FIG. 5 is a front elevational view of a low terminal in accordance with the invention.

As seen in FIGS. 4–6, the preferred embodiment of the invention has terminals of three distinct types for insertion into and retention within terminal retention cavities 14. The preferred embodiment of the invention has a plurality of ground or power terminals 40 (FIG. 4), low terminals 60 (FIG. 5), and middle terminals 70 (FIG. 6). It is not necessary to the invention that the ground terminal 40 is a dedicated ground terminal or that the low and middle terminals 60 and 70 are dedicated signal terminals. However, they are referred to in this manner herein for clarity.

The ground terminal 40 preferably has a generally horizontal base portion 42 having several other portions extending therefrom. In particular, extending from the base portion 42 is a retention portion 44 having barbs 45 for retaining the ground terminal 40 within its associated terminal retention cavity by digging into the housing, a through-hole tail portion 46 for extending through and electrically connecting to a through-hole 32 in the motherboard 30, a surface-mount tail portion 48 having an enlarged foot 49 for electrically engaging a trace or pad 34 on the motherboard 30, a spring arm portion 50 having a contact portion 54 for electrically engaging the pads 28 on the sides 26 of the edge card 20, and an enlarged surface area portion 56. The enlarged surface area portion 56 preferably has a substantially rectangular portion 57 and an upwardly extending, generally tapered triangular-shaped portion 58. The enlarged surface area portion 56 facilitates electrical coupling between the particular ground terminal 40 and an adjacent terminal. This form of coupling is particularly useful in enhancing the cross-coupling between ground/power and adjacent signal terminals and diminishing the cross-coupling between adjacent signal terminals in the preferred embodiment.

The enlarged surface area portion 56 also enables the ground terminal 40 to carry larger current, as is often required in a ground/power application. Having two connections to the motherboard 30 as it does with the through-hole tail portion 46 and the surface-mount tail portion 48 also facilitates a larger aggregate current by splitting the current through these two paths to the motherboard. In this embodiment, the two tail portions 46 and 48 are approximately equidistantly disposed from the main current path of the ground terminal 40, namely where the spring arm portion 50 meets the base portion 42 approximately at the center of the base portion 42. The approximately equidistant disposition has the benefit of dividing the current nearly evenly between the two pathways due to nearly equal impedance.

The spring arm portion 50 preferably includes a vertical portion 51 extending from the rectangular portion 57 of the enlarged surface area portion 56 and in a direction away from the base portion 42 of the ground terminal 40, an inwardly angled portion 52 extending further upwardly from the end of the vertical portion 51 to a contact portion 54, the most inwardly projecting section of the spring arm portion 50, and an outwardly angled portion 53 extending further upwardly and generally outwardly from the contact portion 54. This outwardly angled portion 53 is tapered to act as a lead-in and to permit smooth deflection of spring arm portion 50 by insertion edge 22 of edge card 20. The tip 55 of the terminals 40 is also intended to be captured between transverse walls 15 of terminal receiving cavity 14 to minimize side deflection of the terminal.

The low terminal 60, shown in detail in FIG. 5, preferably has a base portion 61, a retention portion 62 extending upwardly therefrom, a surface mount tail portion 64 extending downwardly and outwardly from the outer end of the base portion 61, and a spring arm portion 66 projecting upwardly and inwardly from the base portion 61. The retention portion 62 preferably has barbs 63 for retaining the low terminal 60 in its appropriate terminal retention cavity. The surface-mount tail portion 64 preferably has a foot 65 for electrically connecting in surface-mount fashion the low terminal 60 to a trace or pad 34 on the surface of the motherboard 30. The spring arm portion 66 of the low terminal 60 preferably has an inwardly angled portion 67 extending upwardly and inwardly from the base portion 61 to a contact portion 69, the most inwardly projecting point of the spring arm portion 66. Extending further upwardly and outwardly from the contact portion 69 is an outwardly angled portion 68 and tip 68' for the same purposes as described above with respect to outwardly angled portion 53 and tip 55 of ground terminal 40.

The middle terminal 70, shown in detail in FIG. 6, preferably has a base portion 71, a retention portion 72 extending upwardly therefrom, a surface mount tail portion 74 extending downwardly and outwardly from the outer end of the base portion 71, and a spring arm portion 76 projecting upwardly and inwardly from the base portion 71. The retention portion 72 preferably has barbs 73 for retaining the middle terminal in its appropriate terminal retention cavity. The surface-mount tail portion 74 preferably has a foot 75 for electrically connecting in surface-mount fashion the middle terminal 70 to a trace or pad 34 on the surface of the motherboard 30. The spring arm portion 76 of the middle terminal 70 preferably has an inwardly angled portion 77 extending upwardly and inwardly from the base portion 71 to a contact portion 79, the most inwardly projecting point of the spring arm portion 76. Extending further upwardly and outwardly from the contact portion 79 is an outwardly angled portion 78 and a tip 78' of the spring arm portion 76 in the preferred embodiment. As such, the middle terminal 70 is substantially identical to low terminal 60 except that spring arm portion 76 of terminal 70 is longer and has a different slope than spring arm portion 66 of terminal 60.

As shown schematically in FIG. 8, the three distinct terminals 40, 60, and 70 are strategically placed within terminal retention cavities 14 on each side of the longitudinal slot 13. In particular, the three distinct terminals are each used exactly once in a repeated sequence on each side of the slot 13. In the preferred embodiment, the sequences run in opposite directions on each side of the slot from any pair of low terminals 60 that are aligned opposite one another across the slot 13. In accordance with that arrangement, each middle terminal 70 is thereby opposed by a ground terminal 40 and each ground terminal is opposed by a middle terminal.

This strategic arrangement provides for exactly one low signal terminal and one middle signal terminal between each pair of adjacent large dedicated ground terminals on each side of the slot. The strong coupling tendencies of the large ground terminals and their enlarged surface areas tend to electrically isolate the interposed adjacent signal terminals and thereby diminish cross-talk therebetween. Furthermore, the differentiated heights of the terminals, as shown in FIGS. 2 and 3, in particular the adjacent low and middle signal terminals 60 and 70, and the different slopes of the spring arm portions of the terminals also reduce the cross-coupling therebetween.

Figure 2:
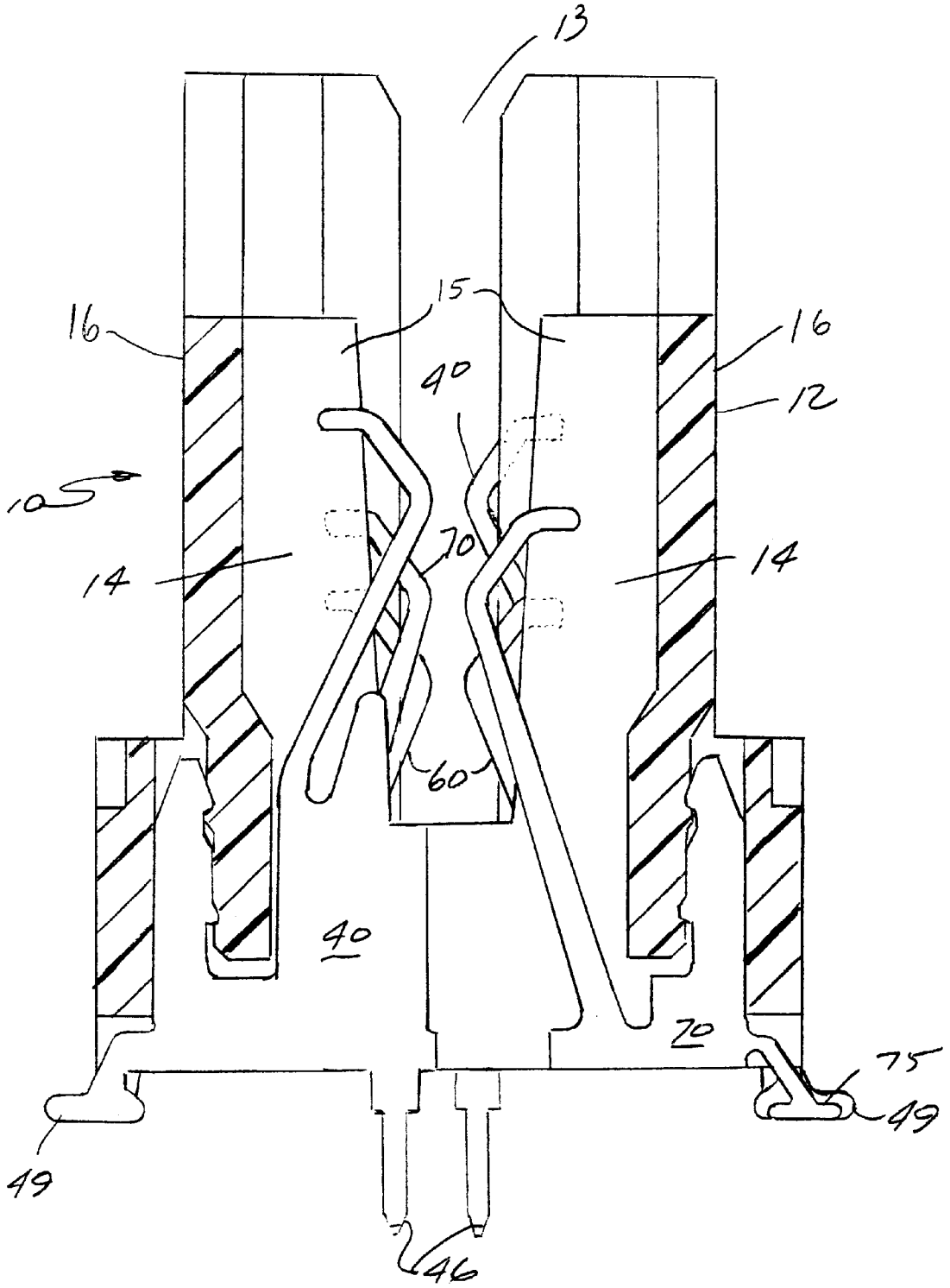
FIG. 2 is a cross-sectional view of the connector of FIG. 1 as taken generally along line 2—2.
Figure 3:
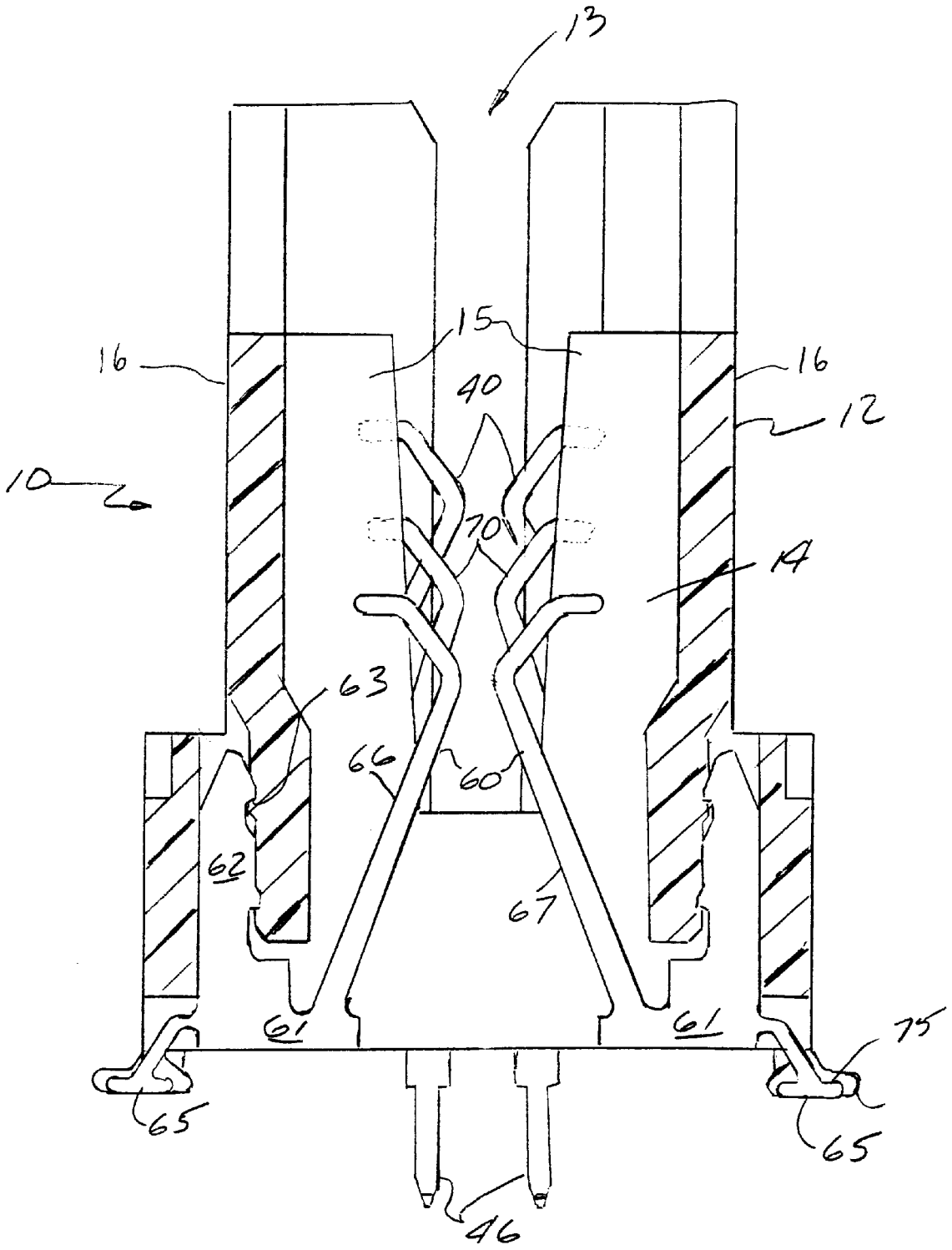
FIG. 3 is a cross-sectional view of the connector of FIG. 1 as taken generally along line 3—3.

FIGS. 2 and 3 show cross-sectional views perpendicular to the longitudinal slot 13 to show the differing heights and angles of the contact arms of the three distinct terminals. It can also be seen therein how the barbed retention portions retain the terminals in their respective terminal retention cavities. The staggered heights not only diminish cross-coupling, but also serve to stagger the insertion forces when the edge card 20 is inserted into the longitudinal slot 13, thereby diminishing the maximum insertion force.

The preferred embodiment of the invention, as described above, provides significant advantages over previous connectors, particularly with regard to the increased speed of the connector. From the foregoing, it will be appreciated that the invention provides a novel, high-speed edge connector for mechanically and electrically connecting electrical circuits. The invention is not limited to the preferred embodiment described herein, or to any particular embodiment. Specific examples of alternative embodiments considered to be within the scope of the invention include embodiments wherein the three distinct terminals may have different shapes than those described herein. The terminals may have different functions within the connector, such as wherein they do not specifically carry the ground/power and/or signal loads ascribed to them in the preferred embodiment, wherein the distinct terminals are strategically placed differently within the terminal retention cavities of the housing, and wherein the various terminals have alternative combinations of through-hole and/or surface-mount tails. Other modifications to the preferred embodiment may also be made within the scope of the invention. The invention is defined by the following claims.

What is claimed is:

1. An electrical edge connector for electrically and mechanically connecting a first electrical circuit board to a second electrical circuit board, said first electrical circuit board having an insertion edge and two generally planar faces, said connector comprising:

an elongated dielectric housing having therein a longitudinal slot for receiving said insertion edge of said first electrical circuit board and a plurality of transverse terminal receiving cavities adjoining said slot on each side of said slot; and a plurality of signal terminals disposed within some of said terminal receiving cavities on each side of said slot and a plurality of ground terminals disposed within others of said terminal receiving cavities on each side of said slot, said signal and ground terminals each having a base portion, a retention portion extending from said base portion and retaining said terminal in one of said retention cavities, a tail portion extending from said base portion for electrically connecting said terminal to said second electrical circuit board, and a spring arm connected to said base portion for electrically connecting said terminal to said first electrical circuit board;

said base portion of each said ground terminal including a first generally rectangular section extending generally along a lower surface of said housing, a second generally rectangular section extending up from said first generally rectangular section, a portion of said second generally rectangular section extending along a portion of said slot, and a generally tapered, enlarged surface area portion extending from said second generally rectangular section for enhancing electrical coupling between said ground terminal and an adjacent signal terminal.

2. An electrical edge connector in accordance with claim 1 wherein said spring arm of each said ground terminal includes an upwardly and inwardly inclined portion spaced generally along said tapered, enlarged surface area portion.

3. An electrical edge connector in accordance with claim 1 wherein each said ground terminal includes two tail portions extending from said base portion for electrically connecting said terminal to said second electrical circuit board.

4. An electrical edge connector in accordance with claim 3 wherein one of said two terminal portions is for surface mounting to said second electrical circuit board and another one of said two terminal portions is for mounting to said second electrical circuit board in through-hole fashion.

5. An electrical edge connector in accordance with claim 3 wherein said ground terminal has exactly two tail portions, and said contact portion meets said base portion approximately equidistantly from where said two tail portions meet said base portion.

6. An electrical edge connector in accordance with claim 1 wherein said enlarged surface area portion is a generally triangularly shaped portion extending up from said second generally rectangular section and wherein said spring arm of said ground terminal includes an upwardly and inwardly inclined portion spaced generally evenly from said generally triangularly shaped portion.

7. A terminal for an electrical edge connector for connecting a first electrical circuit board to a second electrical circuit board, wherein said first electrical circuit board has an insertion edge and two generally planar faces and said connector has an elongated dielectric housing having therein a longitudinal slot for receiving said insertion edge of said first electrical circuit board and a plurality of transverse terminal receiving cavities adjoining said slot on each side of said slot, said terminal comprising:

a base portion, including a first generally rectangular section extending generally along a lower surface thereof, a second generally rectangular section extending up from said first generally rectangular section, a portion of second generally rectangular section configured to extend along a portion of said slot, and a generally tapered, enlarged surface area portion extending from said second generally rectangular section for enhancing electrical coupling between said terminal and an adjacent signal terminal;

a retention portion extending from said base portion for retaining said terminal in one of said receiving cavities;

a tail portion extending from said base portion for electrically connecting said terminal to said second electrical circuit board; and a spring arm connected to said base portion for electrically connecting said terminal to said first electrical circuit board, said spring arm including an upwardly and inwardly inclined portion spaced generally evenly along said tapered, enlarged surface area portion.

8. A terminal in accordance with claim 7 wherein said terminal comprises two tail portions extending from said base portion for electrically connecting said terminal to said second electrical circuit board.

9. A terminal in accordance with claim 8 wherein one of said two terminal portions is for surface mounting to said second electrical circuit board and another one of said two terminal portions is for mounting to said second electrical circuit board in through-hole fashion.

10. A terminal in accordance with claim 8 having exactly two tail portions, said spring arm meeting said base portion approximately equidistantly from where said two tail portions meet said base portion.

11. A terminal in accordance with claim 8 wherein said enlarged surface area portion is a generally triangularly shaped portion extending up from said second generally rectangular section and wherein said upwardly and inwardly inclined portion of said ground terminal is generally evenly spaced from said generally triangularly shaped portion.

12. An electrical edge connector for electrically and mechanically connecting a first electrical circuit board to a second electrical circuit board, said first electrical circuit board having an insertion edge and two generally planar faces, said connector comprising:

an elongated dielectric housing having therein a longitudinal slot for receiving said insertion edge of said first electrical circuit board and a plurality of transverse terminal receiving cavities adjoining said slot on each side of said slot; and a plurality of signal terminals disposed within some of said terminal receiving cavities on each side of said slot and a plurality of ground terminals disposed within others of said terminal receiving cavities on each side of said slot, each said signal terminal having a base portion, a retention portion extending from said base portion and retaining said signal terminal in one of said retention cavities, a tail portion extending from said base portion for electrically connecting said terminal to said second electrical circuit board, and a spring arm connected to said base portion for electrically connecting said terminal to said first electrical circuit board;

each said ground terminal having a base portion including a first generally rectangular section extending generally along a lower surface of said housing, a second generally rectangular section extending up from said first generally rectangular section, a portion of second generally rectangular section extending along a portion of said slot, and a generally tapered, enlarged surface area portion extending from said second generally rectangular section for enhancing electrical coupling between said ground terminal and an adjacent signal terminal, said ground terminal further having a retention portion extending from said base portion and retaining said ground terminal in one of said retention cavities, a tail portion extending from said base portion for electrically connecting said terminal to said second electrical circuit board, and a spring arm connected to said second generally rectangular section for electrically connecting said terminal to said first electrical circuit board, said spring arm including an upwardly and inwardly inclined portion spaced generally evenly from said tapered, enlarged surface area portion.

13. An electrical edge connector in accordance with claim 12 wherein each said ground terminal includes two tail portions extending from said base portion for electrically connecting said terminal to said second electrical circuit board.

14. An electrical edge connector in accordance with claim 13 wherein one of said two terminal portions is for surface mounting to said second electrical circuit board and another one of said two terminal portions is for mounting to said second electrical circuit board in through-hole fashion.

15. An electrical edge connector in accordance with claim 13 wherein said ground terminal has exactly two tail portions, and said contact portion meets said base portion approximately equidistantly from where said two tail portions meet said base portion.

16. An electrical edge connector in accordance with claim 12 wherein said enlarged surface area portion is a generally triangularly shaped portion extending up from said second generally rectangular section and wherein said upwardly and inwardly inclined portion of said ground terminal is generally evenly spaced from said generally triangularly shaped portion.

* * * * *